US006382037B1

(12) United States Patent
Kobayashi et al.

(10) Patent No.: US 6,382,037 B1
(45) Date of Patent: May 7, 2002

(54) STARTER

(75) Inventors: Takehiro Kobayashi; Shigeru Shiroyama; Akira Kuragaki; Koichiro Kamei; Hidekazu Katayama; Masahiko Tsukahara; Tadanori Yamaguchi; Jiro Hirao, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/456,505

(22) Filed: Dec. 8, 1999

(30) Foreign Application Priority Data

May 20, 1999 (JP) ..... 11-140790

(51) Int. Cl.[7] ..... F02N 11/00
(52) U.S. Cl. ..... 74/7 A; 74/7 E
(58) Field of Search ..... 74/7 C, 7 R, 6, 74/7 A, 7 E

(56) References Cited

U.S. PATENT DOCUMENTS

| | | | | |
|---|---|---|---|---|
| 4,740,353 A | * | 4/1988 | Cogan et al. | 420/49 |
| 4,985,092 A | * | 1/1991 | Kaede et al. | 148/326 |
| 5,118,960 A | * | 6/1992 | Sasamoto et al. | 290/48 |
| 5,901,604 A | | 5/1999 | Sato et al. | |

FOREIGN PATENT DOCUMENTS

| | | | |
|---|---|---|---|
| JP | 55-11107 | * | 1/1980 |
| JP | 7-188863 | * | 7/1995 |
| JP | 8-319929 | | 12/1996 |
| JP | 9-302456 | * | 11/1997 |
| JP | 2865808 | | 12/1998 |
| JP | 11-61351 | * | 3/1999 |

* cited by examiner

*Primary Examiner*—Lenard A. Footland
*Assistant Examiner*—William C. Joyce
(74) *Attorney, Agent, or Firm*—Sughrue Mion, PLLC

(57) ABSTRACT

To prevent an attracting force to the plunger from becoming insufficient, at least one of an output shaft and a thrust spline is formed from magnetic material having a lower relative permeability than iron.

1 Claim, 8 Drawing Sheets

STARTER

BACKGROUND OF THE INVENTION

1. [Field of the Invention]

The present invention relates to a starter for starting an engine.

2. [Description of the Prior Art]

Up to the present time, a starter (a coaxial type starter) coaxially arranging an electromagnetic switch, an over-running clutch provided with a pinion to mesh with a ring gear, a plunger (movable core) on an output shaft is known.

This type of starter operates as shown below.

That is, when current is sent to an exciting coil of the electromagnetic switch, the plunger is attracted by an exciting core of the electromagnetic switch and after a short period when the plunger begins to move, a movable contact and a stationary contact are brought into contact and electric power is supplied to a DC motor so that the output shaft is rotated by way of a motor shaft and a reduction mechanism. Then, the over-running clutch that is spline-connected to the output shaft moves toward the ring gear, the pinion and the ring gear mesh and the engine is started.

The plunger is formed in a tubular shape, arranged so as to cover the outer circumference of the output shaft and move the over-running clutch toward the ring gear.

Further, the over-running clutch is a so-called one-way clutch having a thrust spline that has a tubular portion with a helical spline formed on the inner circumference for spline-connection with a helical spline formed on the output shaft.

In the above-mentioned starter, the output shaft and the thrust spline of the over-running clutch that is spline-connected to this output shaft are generally formed from hardened steel for strength.

However, when the output shaft and the thrust spline are formed from the hardened steel, considerable magnetic flux leaks to the output shaft from the plunger and to the thrust spline from the output shaft. In addition, when the exciting core of the electromagnetic switch begins to attract the stationary state plunger, the attracting force (the initial attracting force) will become insufficient. That is, there has been a problem whereby the attracting force to the plunger becomes insufficient.

In the above-mentioned case, it would be possible to reduce the leakage of magnetic flux by providing a large distance between the output shaft and the plunger (the distance between the inner circumference of the plunger and the outer circumference of the output shaft (air gap)); however, this creates a problem inasmuch as the size of the starter increases in the radial direction large and as a result, the overall starter size is too great.

For instance, Japanese Published Unexamined Patent Application No. 31992-1996 disclosed that an output shaft formed using non-magnetic material (generally, material having a relative permeability $\mu$ lower than 1.02, for instance, such as stainless steel, brass, resin, etc.) is used so as not to disturb the magnetic field around an electromagnetic switch.

According to this, hardly any magnetic flux leaks to the output shaft and it becomes possible to improve the attracting force to the plunger. Further, it is possible to reduce the distance between the plunger and the output shaft. Therefore, the size in the radial direction can be reduced and the size of the entire starter can be reduced.

However, there has been a problem wherein an output shaft and a thrust spline of an over-running clutch are spline-connected and strong pressure is applied to the output shaft and a helical spline portion of the thrust spline when operating a starter as mentioned above, therefore, if an output shaft and a thrust spline formed with non-magnetic material are used, there is a strength-related problem.

Further, as mentioned above, if the output shaft and the thrust spline formed using hardened steel are used, there is no problem in connection with strength; however, considerable magnetic flux leaks to the output shaft and the thrust spline, and the attracting force to the plunger becomes insufficient. In this case, a problem is created wherein in order to assure a sufficient attracting force to the plunger, the starter becomes large in size.

SUMMARY OF THE INVENTION

The present invention was made to solve such problems as mentioned above and its object is to provide a starter capable of securing strength of an output shaft as well as a thrust spline, reducing leakage of magnetic flux and assuring sufficient attracting force to a plunger.

Another object is to provide a starter that can be made small in size.

At least one of an output shaft and a thrust spline of a starter of the present invention is formed from magnetic material having a lower relative permeability than iron.

Further, at least one of an output shaft and a thrust spline is formed from heat-treated martensitic stainless steel.

Further, at least one of an output shaft and a thrust spline is formed from hardened Austenitic stainless steel material.

The above and other objects, features and advantages of the present invention will become more apparent from the following description when taken in conjunction with the accompanying drawings.

DESCRIPTION OF THE PREFERRED EMBODIMENTS

[First Embodiment]

A first embodiment of a starter of the present invention will be described below referring to the attached FIG. 1~FIG. 3.

Figure 1:
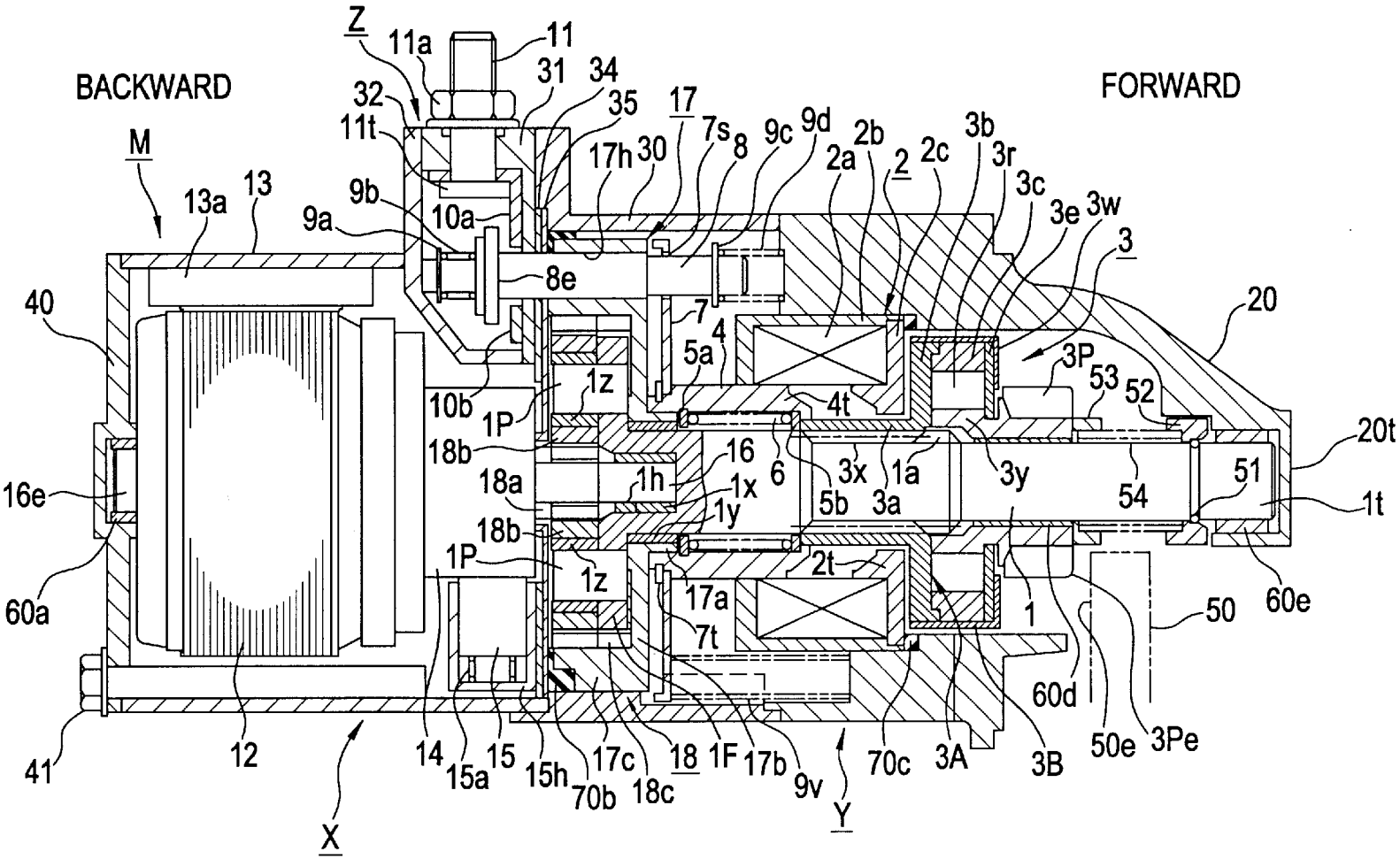
FIG. 1 is a sectional view showing the structure of a starter according to first, second and third embodiments of the present invention.

FIG. 1 is a sectional view showing the structure of a starter according to the first, second and third embodiments of the present invention.

The starter according to the first embodiment is covered with a front bracket 20, a center bracket 30 and a rear bracket 40 and presents a bullet-shape exterior appearance. Further, an opening is formed to receive a ring gear 50.

In the starter, there are arranged a DC motor M, an output shaft 1 driven by the DC motor M. A ring shape electromagnetic switch 2, an over-running clutch 3, a plunger (movable core) 4, etc. are arranged around the output shaft 1.

That is, the starter according to the first embodiment has such a structure that the electromagnetic switch 2, the over-running clutch 3 and the plunger 4 are coaxially arranged on the output shaft 1. This is called a coaxial type starter.

The starter in the first embodiment uses an output shaft 1 that is formed from martensitic stainless steel that has been heat-treated through, for instance, a high frequency hardening treatment by microwave.

When heat-treated, martensitic stainless steel has high strength but is strongly magnetized.

However, its relative permeability is lower than other high-strength magnetic materials (for instance, ferrous materials) by more than several tens to 200 times and the magnetic field around the electromagnetic switch is less affected (relative permeability of ferrous materials is several thousands but that of hardened martensitic stainless steel used in the first embodiment is about 100).

Figure 2:
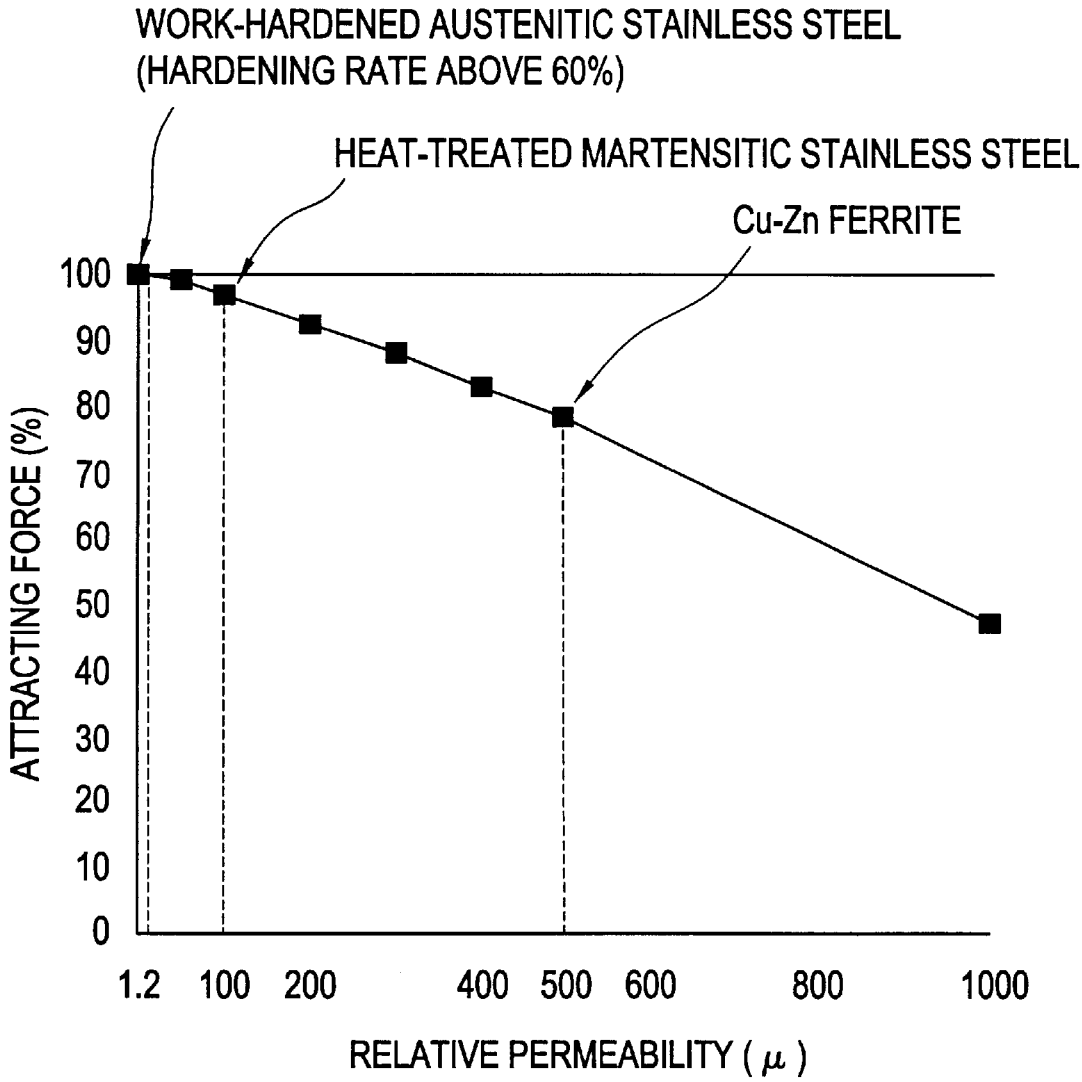
FIG. 2 is a diagram for explaining the first, second and third embodiments.

FIG. 2 is a comparison graph of initial attracting forces in materials used for the output shaft 1 according to the present invention when a value of the initial attracting force (the attracting force when the plunger begins to move) of an output shaft formed from a non-magnetic material with relative permeability $\mu$ of 0 is 100.

As is clear from FIG. 2, the relative permeability $\mu$ of heat-treated martensitic stainless steel is 100 and its attracting force is 97.

Accordingly, the same initial attracting force is obtained as when an output shaft is formed using non-magnetic material.

Figure 3:
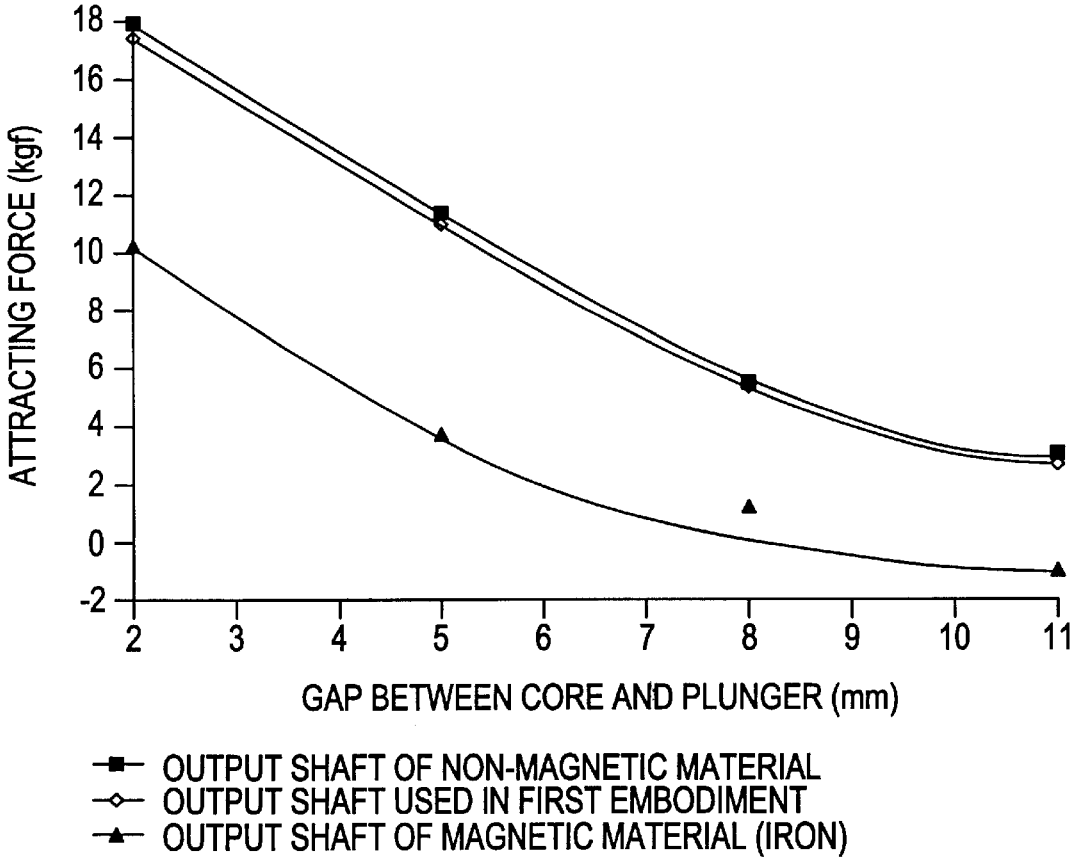
FIG. 3 is a diagram for explaining the first embodiment.

FIG. 3 shows the relationship of a distance (gap) between the plunger 4 and an exciting core 2*c* of the electromagnetic switch 2 with an attracting force to attract the plunger 4 to the exciting core 2*c* side.

Further, shown in FIG. 3 is a comparison of attracting forces of a conventional output shaft formed from non-magnetic material, a conventional output shaft formed from ferrous magnetic material and the output shaft 1 formed from martensitic stainless steel material which has undergone a high frequency hardening treatment in this first embodiment.

As is clear from FIG. 3, when the output shaft 1 formed from martensitic stainless steel material after the high frequency hardening treatment was used as in the first embodiment, almost the same attracting force as that obtained when a conventional output shaft formed using non-magnetic material was used is obtained in connection with a gap between the plunger 4 and the exciting core 2*c*.

According to the first embodiment, it is possible not only to assure the strength of the output shaft 1 but also to reduce leakage of magnetic flux to the output shaft 1 and a thrust spline 3A. A starter capable of assuring almost the same attracting force as that obtained when a conventional output shaft formed from non-magnetic material is used is obtained.

Further, as leakage of magnetic flux to the output shaft 1 and the thrust spline 3A can be reduced, it is possible to further reduce the distance between the output shaft 1 and the plunger 4 (the distance between the tubular inner circumference of the plunger 4 and the outer circumference of the output shaft 1 (air gap)) and make the starter small in size.

Further, the output shaft 1 formed from martensite stainless steel material which has undergone with other heat treatment is also usable.

[Second Embodiment]

Although the output shaft 1 formed of heat treated martensitic stainless steel is used in the first embodiment, the same effect can be obtained even when the output shaft 1 formed of austenitic stainless steel subject to the work hardening treatment is used.

As is clear from FIG. 2, the relative permeability $\mu$ of austenitic stainless steel subject to the work hardening treatment (a work hardening rate of 60%) is 1.2 and its attracting force is almost 100.

Accordingly, the same initial attracting force as that obtained when an output shaft formed of a non-magnetic material was used is obtained.

Further, when a material volume is hardened from a state of 100 to a state of 50, the hardening rate is 50% and a hardening rate 60% or above means work hardening to reduce the volume from 100 to 40 or below.

Therefore, according to the second embodiment, almost the same effect as in the first embodiment can be obtained.

[Third Embodiment]

Further, as is clear from FIG. 2, even when the output shaft formed of magnetic material of a relative permeability of 1000 is used, the initial attracting force that is at least half of the initial attracting force is obtainable when the output shaft formed of non-magnetic material is used. It is therefore possible to assure the strength of the output shaft 1 and a larger attracting force than that obtained when an output shaft formed of conventional hardened steel material is used.

In short, when an output shaft formed of magnetic material of a lower relative permeability than iron is used, the strength of the output shaft 1 is assured and a starter that has an attracting force higher than that obtained by using an output shaft formed of conventional hardened steel material is obtained.

Even in these cases, the attracting force can be improved when the heat treated martensitic stainless shown in the first embodiment is used in combination with the thrust spline 3A formed by hardened austenitic stainless steel shown in the second embodiment or with a technique to provide a large distance between the output shaft 1 and the plunger 4. However, when such a technique to increase the distance between the output shaft 1 and the plunger 4 is used, the downsizing of the starter will be sacrificed.

Further, if the output shaft 1 formed from a magnetic material of relative permeability 1.2~500 is used (for instance, Cn—Zn ferrite), about 80% of the initial attracting force that is obtained when using an output shaft formed by non-magnetic material can be obtained and a good effect can be expected.

Needless to say, it is possible to obtain a starter which is effective in assuring the strength of the output shaft 1 and the thrust spline 3A, obtaining the attracting force of the electromagnetic switch 2, and downsizing when the output shaft 1 formed from a magnetic material of heat treated martensitic stainless steel or hardened austenitic stainless steel or a magnetic material having lower relative permeability than iron is used. Also the thrust spline 3A formed by these materials is used in combination as described in the above-mentioned embodiments.

In addition, even when the output shaft 1 is formed using hardened steel as before and the thrust spline 3A only is formed using magnetic materials as explained in the above embodiments, higher effects than for a conventional starter which uses an output shaft and an thrust spline formed of hardened steel are obtained in assuring the strength of the thrust spline 3A and the attracting force, and achieving the downsizing.

The structure and operation of a starter in the first, second and third embodiments will be described below in detail.

In FIG. 1, the left side portion is the DC motor portion X, the right side is the operating portion Y and the upper side close to the center is the contact chamber Z. Hereinafter, the motor side is referred to as the backside and the ring gear side as the forward side.

As is well known, the DC motor M comprises an armature 12, a yoke 13 to cover the portion around the armature 12, a stationary magnetic pole 13*a* provided in the yoke 13, a commutator 14, brushes 15, and a shaft 16. The armature 12 is an armature core with an armature coil wound around it.

The forward side of the shaft 16 penetrates the cylindrical space of the cylindrical commutator 14 and is connected to a reduction mechanism 18.

The armature coil is connected to the commutator 14. The DC motor M is available in 2-pole, 3-pole, 4-pole and 6-pole types depending on the number of stationary magnetic poles. For instance, taking a case using a 6-pole DC motor as an example, a total of 6 units of the stationary magnetic pole 13 are provided by arranging a N-pole and a S-pole alternately, and the brushes 15 in contact with the commutator 14 are arranged along the circumference of the commutator 14.

Further, 15*a* is a spring that pushes the brush 15 against the commutator 14. 15*h* is a brush holder.

The output shaft 1 is driven by the DC motor M in the structure as described above.

The operating portion Y comprises the reduction mechanism 18, the output shaft 1, the electromagnetic switch 2, the over-running clutch 3 and the plunger 4. 17 is an inner gear member. This member comprises a first tubular portion 17*a* which is fitted to the outer circumference of the output shaft 1 via a bearing 1*y*, a tubular disk shape bottom plate portion 17*b* which extends in the direction perpendicular to the outer circumference of the output shaft 1 from the first tubular portion 17*a*, and a second tubular portion 17*c* that has an inner gear 18*c* on the inner circumference.

The reduction mechanism 18 comprises an inner gear 18*c* of the inner gear member 17, a sun gear 18*a* provided on the shaft 16, a plurality of planet gears 18*b* arranged around this sun gear 18*a* engaging the sun gear 18*a* and the inner gear 18*c*, and a pin 1P that projects from a flange 1F of the output shaft 1 inserted between this group of planet gears 18*b* and a bottom plate 17*b* of the inner gear member 17 and connects each of the planet gears 18*b* to the flange 1F of the output shaft 1. Further, the rotational force of each planet gear 18*b* is transmitted to each pin 1P via a bearing 1*z*.

Further, a round groove 1*h* is formed at the center of the flange 1F of the output shaft 1 and the forward end of the shaft 16 is supported rotatably via a bearing 1*x* provided in the round groove 1*h*.

Figure 4:
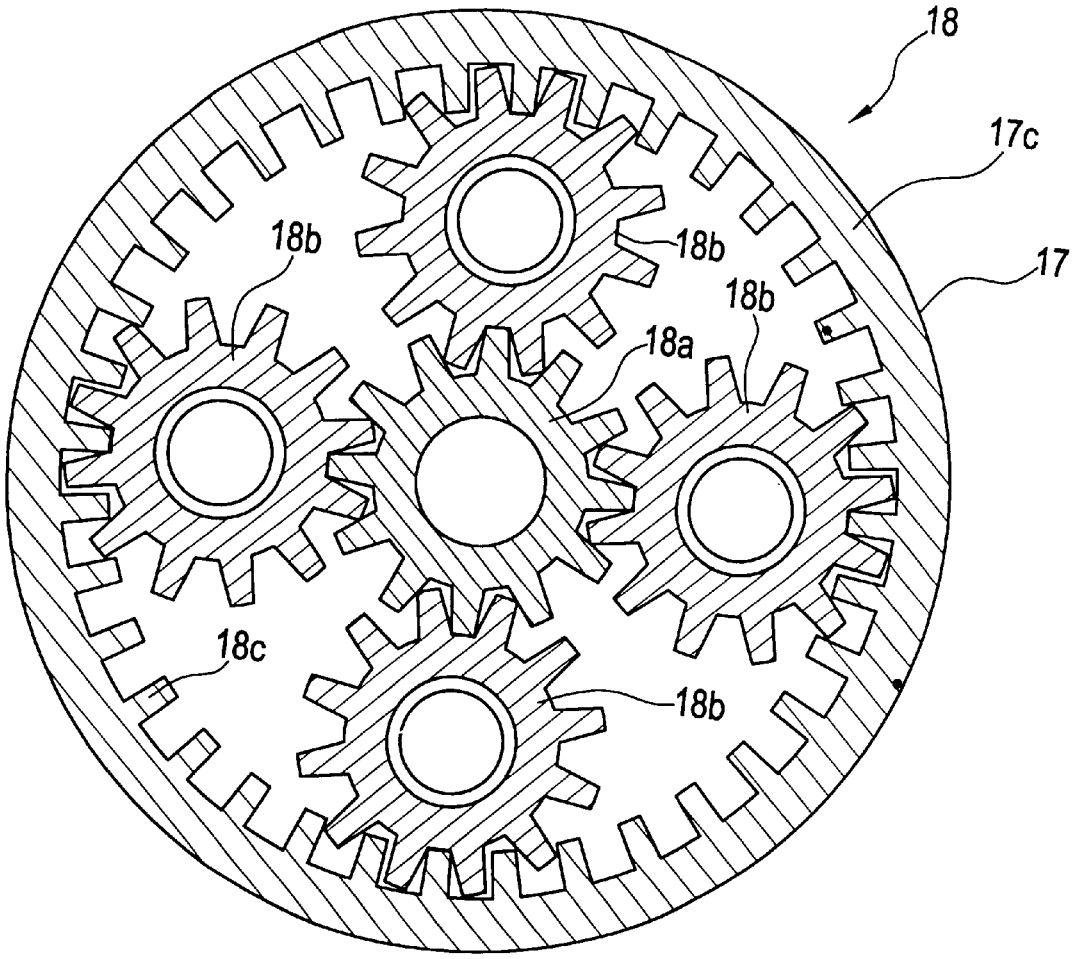
FIG. 4 is a sectional view of a reduction mechanism.

Accordingly, as shown in the sectional view in FIG. 4, when the planet gears 18*b* move round the sun gear 18*a*, the rotational force of the shaft 16 is reduced and transmitted to the output shaft 1 through the pins 1*P*.

Further, a helical spline 1*a* is formed on a part of the outer circumference at the central side of the output shaft 1. On the outer circumference of the part where this helical spline 1*a* is formed, the over-running clutch 3 is arranged so that a tubular portion 3*a* of a thrust spline 3*a* corresponds thereto. Further, on the inner surface of the tubular portion 3*a* of the thrust spline 3A, a helical spline 3*x* is formed to mesh with the helical spline 1*a*. That is, the over-running clutch 3 is spline-connected to the output shaft 1.

Further, the electromagnetic switch 2 is arranged on the peripheral side of the tubular portion 3*a* of the thrust spline 3A.

Further, the plunger 4 is arranged on the outer circumference at the flange 1F side of the output shaft 1.

The over-running clutch 3 comprises the thrust spline 3A that is formed from the tubular portion 3*a* having the helical spline 3*x* formed on its inner surface for meshing with the helical spline 1*a* that is formed on a part of outer circumference at the central side of the output shaft 1, the flange portion 3*b* that is provided at the front side of this tubular portion 3*a* and becomes the cam bottom of a roller cam that is described later, a roller cam 3*c* interposed between the flange portion 3*b* and a washer 3*e* of this thrust spline 3A, a pinion 3P, an inner clutch 3*y* composed of a tubular portion at the base of the pinion 3P, a clutch roller 3*r* arranged in the groove 3*t* formed on the roller cam 3*c*, and a clutch cover 3*w* that covers the outside of the flange portion 3*b*, the roller cam 3*c* and the washer 3*e* of the thrust spline 3A.

Further, the thrust spline 3A and the roller cam 3*c* comprise an outer clutch 3B.

Figure 5:
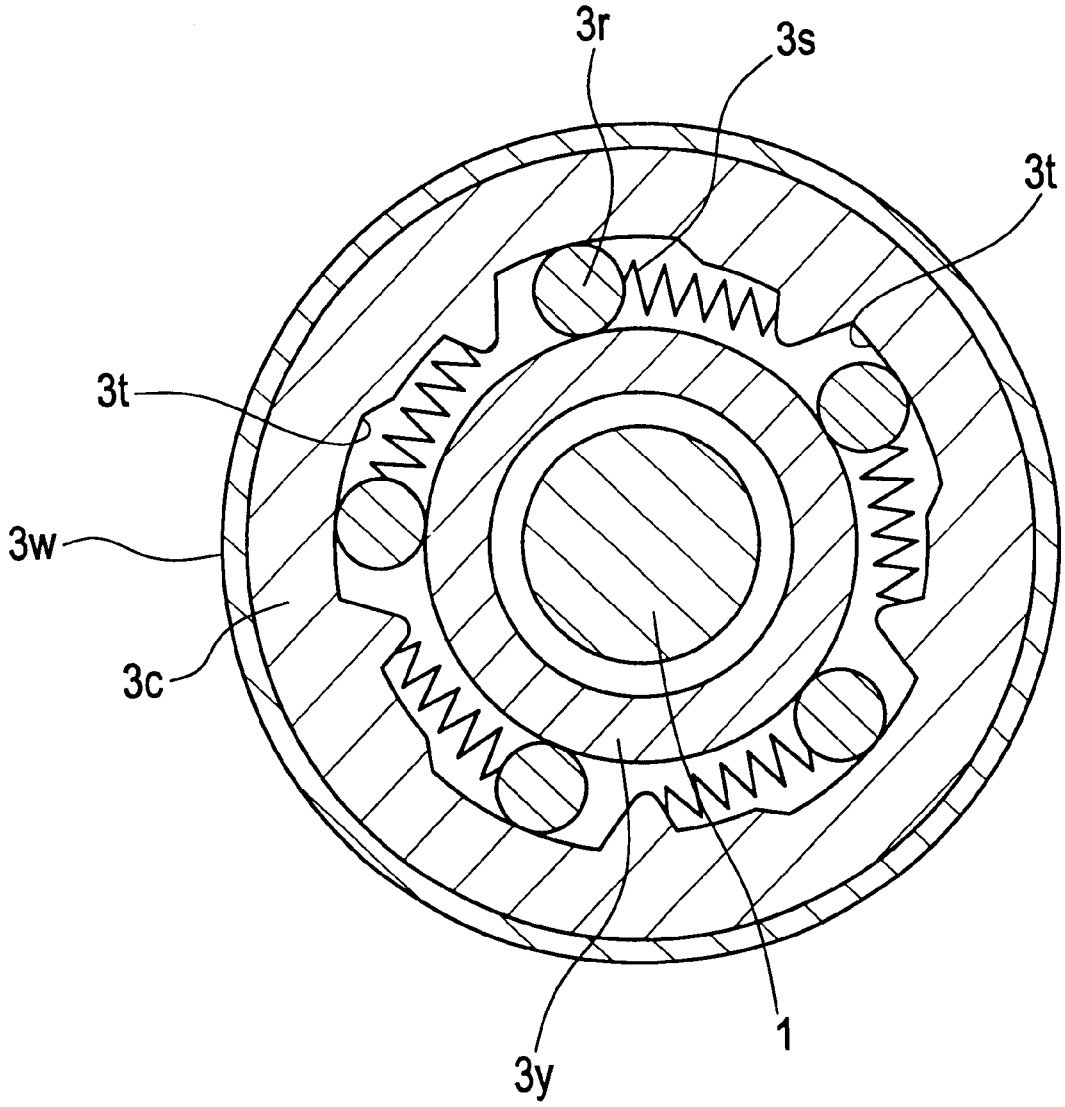
FIG. 5 is a sectional view of an over-running clutch.

The over-running clutch 3 acts as a so-called one-way clutch. The sectional view of the over-running clutch is shown in FIG. 5. At several points on the inner circumference of the roller cam 3*c*, grooves 3*t* are provided to form a narrow space and a wide space between the outer circumference of the inner clutch 3*y*. The clutch roller 3*r* is arranged in each of these grooves 3*t*. 3*s* is a spring for pressing the clutch roller 3*r* toward the narrow space of the groove 3*t*.

When the output shaft 1 is driven by the DC motor M, the roller cam 3*c* is rotated, the clutch roller 3*r* moves to the narrow space of the groove 3*t*, the roller cam 3*c* of the outer clutch 3B meshes with the inner clutch 3*y*, and the pinion 3P rotates and meshes with the ring gear 50. Then, when the pinion 3P is rotated together with the ring gear 50, the clutch roller 3*r* moves to the wide space of the groove 3*t*, the outer clutch 3B and the inner clutch 3*y* are disengaged and the over-running clutch 3 is separated from the engine.

The electromagnetic switch 2 comprises the exciting coil 2*a* and a switch case 2*b* for covering the exciting coil 2*a* and a core 2*c*, and is arranged at the rear side of the position of the over-running clutch 3. The core 2*c* has a hollow shaped disc surface opposing the flange portion 3*b* of the thrust spline 3A and is formed in the ring shaped body arranged so as to penetrate the outer circumference of the tubular portion 3*a* of the thrust spline 3A. The core 2*c* also has a ring shaped projecting portion 2*t* that extends to the rear side at the tubular portion 3*a* side of the thrust spline 3A.

The plunger 4 is made of a tubular body that is arranged in a movable manner between the inner circumference of the switch case 2*b* and the tubular portion 3*a* of the thrust spline 3A. The front end side 4*t* opposing the ring shaped projecting portion 2*t* is formed in a shape corresponding to the shape of the ring shaped projecting portion 2*t*.

A ring shape plate 5*a* is secured on the inner circumference at the rear end side of the plunger 4. In addition, a ring shape plate 5*b* is also provided on the rear end side of the tubular portion 3*a* of the thrust spline 3A of the over-running clutch 3. Between these plates 5*a*, 5*b*, a coil spring 6 is arranged.

Accordingly, the plunger 4 is attracted by the core 2*c* and moves in the direction (forward) of the core 2*c* and the over-running clutch moves as pushed by the plate 5*b* with the movement of the plunger 4. When the pinion 3P once stops moving after the end surface of the pinion 3P is brought into contact with the end surface of a ring gear 50, and the motor is driven and the gear threads fit the grooves of the pinion 3P, the pinion 3P meshes with the ring gear 50 by the elastic force accumulated up to this point in the coil spring 6 that is compressed.

8 is a contact shaft supported in a movable manner in the extended direction of the shaft by a supporting hole 17*h* provided on a part (the upper part in FIG. 1) of a second tubular portion 17*c* of the inner gear member 17. Further, the contact shaft 8 is mounted so as to extend over the operating portion Y and the contact chamber Z via the supporting hole 17*h*.

A movable contact 8*e* is provided at the one end side in the contact chamber Z of the contact shaft 8. Further, at the rear side from this movable contact 8*e*, a ring shape plate 9*a* is secured to the contact shaft 8. Between this plate 9*a* and the movable contact 8*e*, there is provided a coil spring 9*b* for pressing the movable contact 8*e* to the stationary contact side (later described). Further, at the other end of the shaft positioned at the operation position Y side of the contact shaft 8, a ring shape plate 9*c* is secured to the contact shaft 8. A return coil spring 9*d* is provided between this plate 9*c* and a front bracket 20.

Further, a shift plate 7 is mounted on the rear end of the plunger 4. This shift plate 7 is a slender plate extending in the upper and lower directions with a hole formed at the center for mounting it on the rear end of the plunger 4 and a penetrating hole 7*s* at the upper portion corresponding to the contact shaft 8. This shift plate 7 is secured to the plunger 4 with an engaging ring 7*t*. Further, a return coil spring 9*v* is provided between the lower part of the shift plate 7 and the front bracket 20.

The motor portion X, the contact chamber Z and the operating portion Y are divided by parting plates 34, 35.

The contact chamber Z is divided into a contact chamber wall 31 and a contact chamber cover 32. A first stationary contact 10*a* and a second stationary contact 10*b* are provided on the contact chamber wall 31.

The first stationary contact 10*a* is connected to a battery via a terminal volt 11 and the second stationary contact 10*b* is connected to the positive pole brushes via a lead wire and is also connected to the other end of the exciting coil 2*a* of the electromagnetic switch 2.

Further, the terminal bolt 11 is secured with a nut 11*a* and the first stationary contact 10*a* is secured to the contact chamber wall 31 by a bolt head 11*t*.

Further, 33 is an O-ring and 70*b*, 70*c* are packing.

Further, a rear end 16*e* of the shaft 16 is supported rotatably on a rear bracket 40 via a bearing 60*a*. A front end it of the output shaft 1 is supported at an end 20*t* side of the front bracket 20 via a bearing 60*e*.

At the front side of the output shaft 1, a stopper 52 is provided via an engaging ring 51. Also, at the end of the pinion 3P, a stopper 53 is provided. Between these stoppers 52, 53, a return coil spring 54 is provided.

41 is a bolt to secure the rear bracket 40 to the yoke 13.

Figure 6:
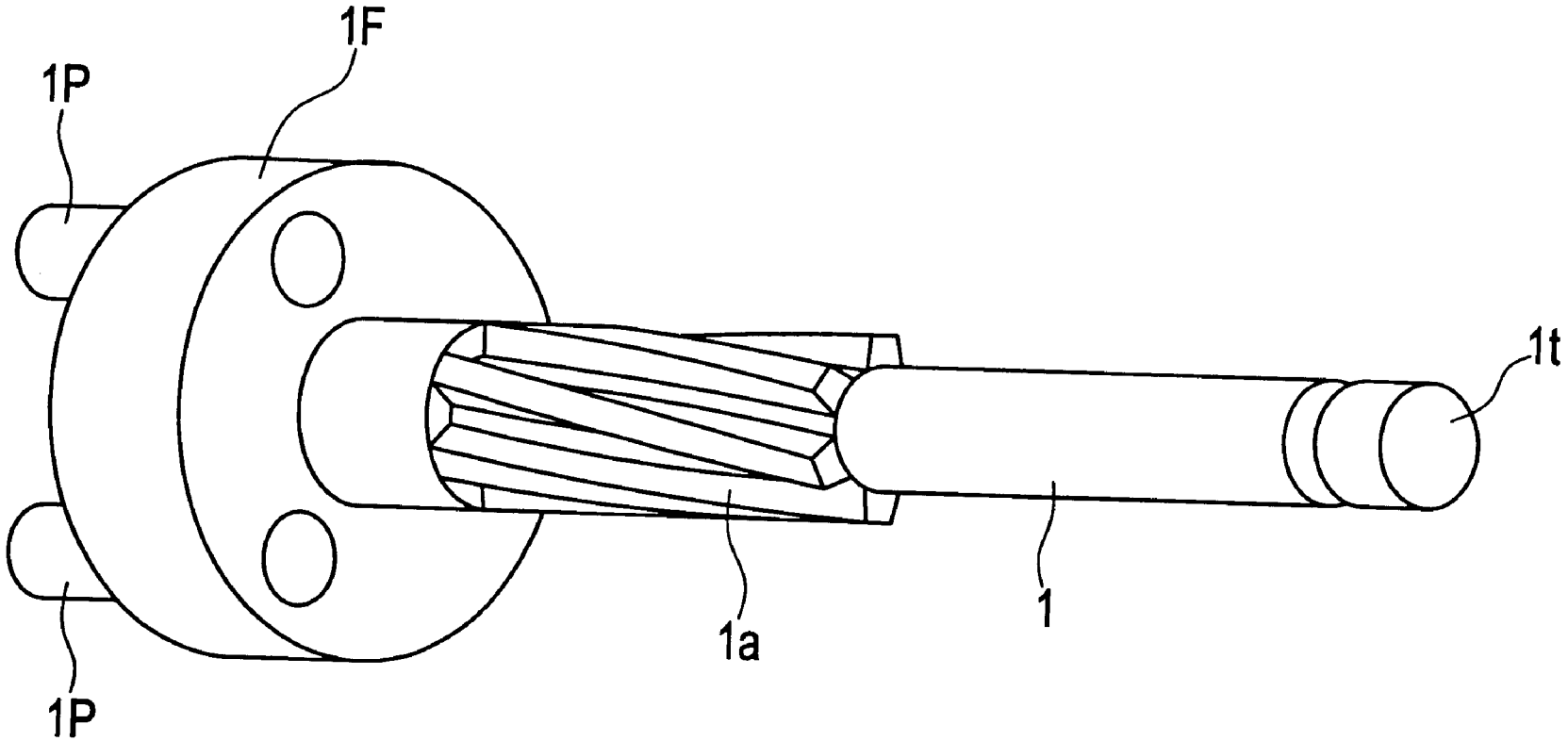
FIG. 6 is a perspective view of an output shaft.
Figure 7A:
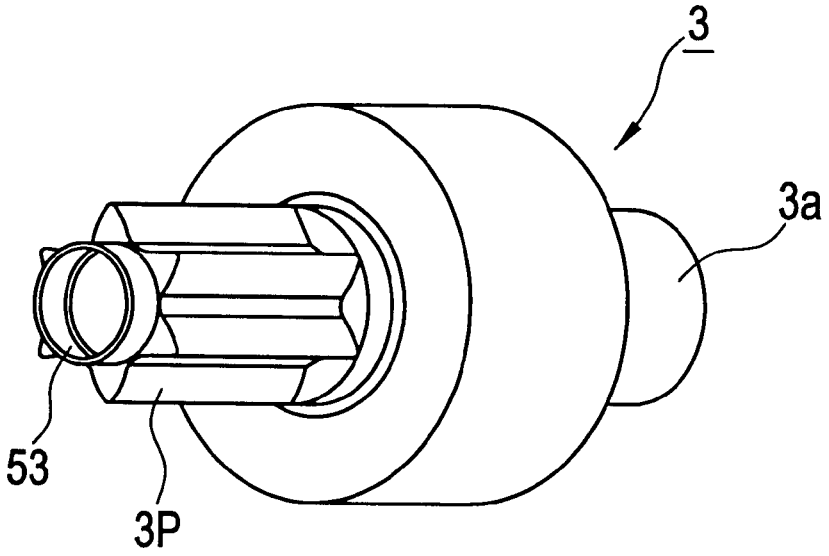
FIGS. 7(*a*) and (*b*) are perspective views of the over-running clutch.
Figure 7B:
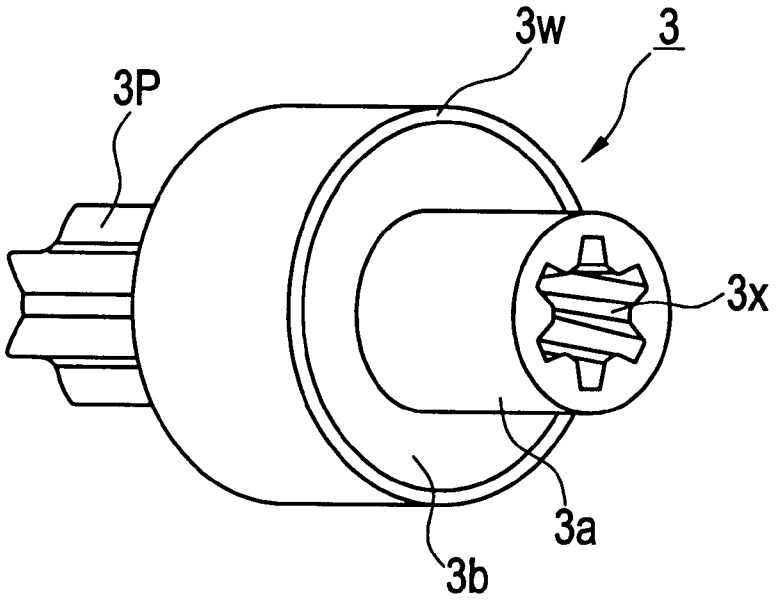
Figure 8:
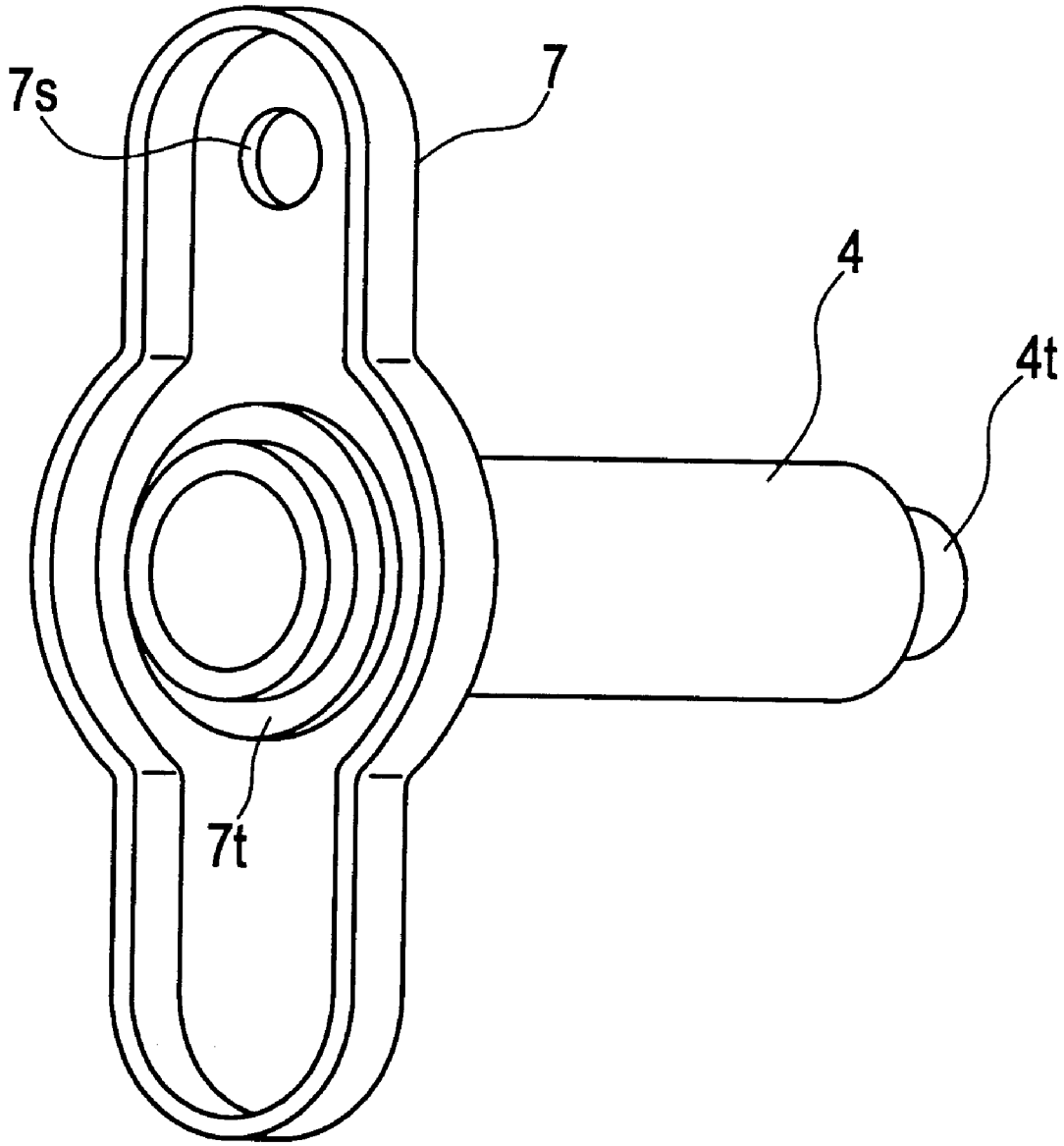
FIG. 8 is a perspective view of a plunger and a shift plate.

FIG. 6 is a perspective view of the output shaft 1, FIG. 7(*a*) and (*b*) show perspective views of the over-running clutch 3, and FIG. 8 shows a perspective view of the plunger 4 and the shift plate 7.

Next, the operation will be described.

When the ignition switch is turned ON and current flows to the exciting coil 2*a* of the electromagnetic switch 2, the plunger 4 is attracted toward the exciting core 2*c*, the plate 5*a* pushes the coil spring 6, the plate 5*b* presses the thrust spline 3A, and the over-running clutch 3 is pushed out toward the ring gear 50. As a result, the end surface 3Pe of the pinion 3P provided at the over-running clutch 3 is brought into contact with the end surface 50*e* of the ring gear 50 and the over-running clutch 3 initially stops to move in the forward direction. However, while the plate 5*a* provided at the inner circumference side of the plunger 4 presses on the coil spring 6, the plunger is further attracted and moves continuously. The shift plate 7 also moves forward and contacts the plate 9*c*.

Thereafter, as the plunger 4 is continuously attracted following this state, the plate 9*c* secured to the contact shaft 8 is pushed by the shift plate 7 and the contact shaft 8 also moves forward. Then, when the movable contact 8*e* of the contact shaft 8 is brought into contact with the first and the second stationary contacts 10*a*, 10*b*, electric power is supplied from a battery, and the armature 12 begins to turn.

Further, the contact shaft 8 moves continuously until the plunger 4 is completely attracted and its end 4*t* side is brought into contact with the exciting core 2*c*. At this time, the coil spring 9*b* is compressed by the plate 9*a* and thus, the movable contact 8*e* is depressed and kept in contact with the first and the second stationary contacts 10*a*, 10*b*.

When the armature 12 begins to turn, its rotational force is decelerated through the reduction mechanism 18 and is transmitted to the output shaft 1, the over-running clutch 3 that is spline-connected to the output shaft and further, to the pinion 3P. Then, when the pinion 3P turns slowly and the threads and grooves of the pinion 3P agree with those of the ring gear, the pinion 3P is pushed forward by the spring force (the elastic force) of the pressed coil spring 6 and completely meshes with the ring gear 50. Thus, as the crankshaft connected to the ring gear turns, the engine is started.

When the engine is started, the output shaft 1 and the pinion 3P are separated by the action of the over-running clutch 3, and the pinion 3P runs idle. Then, when the power supply to the exciting coil 2*a* is stopped, the pinion 3P is disengaged from the ring gear 50 as the plunger 4 and the over-running clutch 3 are returned to their original positions by the return coil springs 9*d*, 9*v*.

Further, when the gear threads and grooves of the pinion 3P agree with those of the ring gear 50, they mesh because the end surface 3Pe of the pinion 3P does not contact the end surface 50*e* of the ring gear 50 and there is no problem.

As described above, according to the starter of the present invention, it is possible to assure the strength of the output shaft and the thrust spline, decrease leakage of magnetic flux to the output shaft and the thrust spline, and to assure an attracting force to the plunger.

Further, it is also possible to make the starter small in size in addition to the above-mentioned effect.

What is claimed is:

1. A starter comprising:

an output shaft driven by an electric motor; and a plunger, an exciting coil, and an over-running clutch coaxially arranged on the output shaft, wherein the plunger is attracted by exciting the exciting coil to drive the motor, and the over-running clutch with a thrust spline spline-connected to the output shaft is moved toward a ring gear to allow a pinion of the over-running clutch to mesh with the ring gear for starting an engine, wherein at least one of the output shaft and the thrust spline is formed from magnetic material that has a lower relative permeability than the periodic element iron, and wherein at least one of the output shaft and the thrust spline is formed from work-hardened austenitic stainless steel material.

* * * * *